US008777281B2

(12) United States Patent
Saitou

(10) Patent No.: US 8,777,281 B2
(45) Date of Patent: Jul. 15, 2014

(54) OUTSIDE HANDLE DEVICE FOR VEHICLE DOOR

(75) Inventor: Tadashi Saitou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 405 days.

(21) Appl. No.: 13/389,655

(22) PCT Filed: Jun. 22, 2010

(86) PCT No.: PCT/JP2010/060519

§ 371 (c)(1),
(2), (4) Date: Feb. 9, 2012

(87) PCT Pub. No.: WO2011/021435

PCT Pub. Date: Feb. 24, 2011

(65) Prior Publication Data

US 2012/0139271 A1 Jun. 7, 2012

(30) Foreign Application Priority Data

Aug. 19, 2009 (JP) ..... 2009-190365

(51) Int. Cl.
*E05B 3/00* (2006.01)
*E05B 65/12* (2006.01)
*E05C 19/06* (2006.01)

(52) U.S. Cl.
CPC ..... *E05B 85/16* (2013.01); *E05B 79/06* (2013.01); *E05B 85/10* (2013.01); *Y10S 292/38* (2013.01)
USPC ..... 292/336.3; 292/80; 292/DIG. 38

(58) Field of Classification Search
CPC ..... E05B 85/10
USPC ..... 292/80, 336.3, DIG. 38
See application file for complete search history.

(56) References Cited

U.S. PATENT DOCUMENTS 6,363,577 B1 * 4/2002 Spitzley ..... 292/336.3
7,344,168 B2 * 3/2008 Matsubara et al. ..... 292/336.3

(Continued)

FOREIGN PATENT DOCUMENTS

CN 101131050 A 2/2008
JP 2003003696 A * 1/2003

(Continued)

*Primary Examiner* — Carlos Lugo
(74) *Attorney, Agent, or Firm* — Carrier Blackman & Associates, P.C.; Joseph P. Carrier; William D. Blackman

(57) ABSTRACT

An outside handle device for a vehicle door is provided which comprises a base mounted on a vehicle door, an operating handle extending lengthwise in a fore-and-aft direction of a vehicle, and a support member assembled to the base while pivotably supporting a supported part formed in one end part, in a longitudinal direction, of the operating handle, wherein the support member pivotably supported on the base so as to be pivotable between a pre-assembly holding position and an assembly completion position is formed so as to be held by the base so that at the pre-assembly holding position the support member can pivot toward the assembly completion position in response to a pressing force acting from the operating handle accompanying an operation of assembling the operating handle, and so as to pivotably clasp the supported part and be engaged with and fixed to the base at the assembly completion position when pivoting accompanying a pressing force acting from the operating handle from the pre-assembly holding position to the assembly completion position. This enables the work efficiency for assembly of the operating handle to be enhanced.

3 Claims, 9 Drawing Sheets

(56) References Cited

U.S. PATENT DOCUMENTS

| | | | | |
|---|---|---|---|---|
| 7,827,736 | B2 | 11/2010 | Sunahara et al. | |
| 7,971,913 | B2 * | 7/2011 | Sunahara et al. | 292/336.3 |
| 8,157,301 | B2 | 4/2012 | Sunahara et al. | |
| 8,459,706 | B2 * | 6/2013 | Yoshino et al. | 292/336.3 |
| 2004/0217602 | A1 | 11/2004 | Nomura et al. | |
| 2008/0088139 | A1 * | 4/2008 | Sunahara et al. | 292/336.3 |

FOREIGN PATENT DOCUMENTS

| | | | | |
|---|---|---|---|---|
| JP | 2008013961 | A | * | 1/2008 |
| JP | 2008-050870 | A | | 3/2008 |
| JP | 2009-256961 | A | | 11/2009 |

* cited by examiner

OUTSIDE HANDLE DEVICE FOR VEHICLE DOOR

TECHNICAL FIELD

The present invention relates to an outside handle device for a vehicle door, the device including a base mounted on the vehicle door, an operating handle extending lengthwise in a fore-and-aft direction of a vehicle, and a support member assembled to the base while pivotably supporting a supported part formed in one end part, in a longitudinal direction, of the operating handle.

BACKGROUND ART

An outside handle device in which, in order to prevent rattling of an operating handle in the fore-and-aft direction of a vehicle in a state in which the operating handle is assembled to a base, a support member for pivotably supporting a handle main body is mounted on the base is known from Patent Document 1.

RELATED DOCUMENTS

Patent Documents

Patent Document 1: Japanese Patent Application Laid-open No. 2008-50870

SUMMARY OF THE INVENTION

Problems to be Solved by the Invention

In the outside handle device disclosed by Patent Document 1 above, after a handle shaft part of the operating handle is engaged with the support member pivotably assembled to the base in a state in which the support member is at an engagement/disengagement position, an operating arm formed on the support member is operated to thus pivot the support member to a support position at which the handle shaft part is pivotably supported by the base and the support member and engage an extremity part of the operating arm with the base, thereby maintaining the position of the support member, which is at the support position. However, in such a structure, when the operating handle is assembled to the base, it is necessary to carry out a two-stage operation, that is, an operation for engaging the handle shaft part of the operating handle with the support member, which is assembled to the base and is at the engagement/disengagement position, and an operation for subsequently operating the operating arm of the support member to thus pivot the support member to the support position and engage the operating arm with the base, and it cannot be said that the work efficiency for assembly of the operating handle to the base is excellent.

The present invention has been accomplished in light of such circumstances, and it is an object thereof to provide an outside handle device for a vehicle door that has enhanced work efficiency for assembly of an operating handle.

Means for Solving the Problems

In order to attain the above object, according to a first aspect of the present invention, there is provided an outside handle device for a vehicle door, comprising a base mounted on a vehicle door, an operating handle extending lengthwise in a fore-and-aft direction of a vehicle, and a support member assembled to the base while pivotably supporting a supported part formed in one end part, in a longitudinal direction, of the operating handle, characterized in that the support member pivotably supported on the base so as to be pivotable between a pre-assembly holding position and an assembly completion position is formed so as to be held by the base so that at the pre-assembly holding position the support member can pivot toward the assembly completion position in response to a pressing force acting from the operating handle accompanying an operation of assembling the operating handle, and so as to pivotably clasp the supported part and be engaged with and fixed to the base at the assembly completion position when pivoting accompanying a pressing force acting from the operating handle from the pre-assembly holding position to the assembly completion position.

Further, according to a second aspect of the present invention, in addition to the first aspect, the base has a pair of support side walls extending along the longitudinal direction of the operating handle while sandwiching the supported part of the operating handle from opposite sides, the support member integrally has a pivoting base portion pivotably supported on an outer end part of the two support side walls, which have been mounted on the vehicle door, an abutment receiving portion provided so as to be connected to the pivoting base portion so as to make one end of the operating handle abut thereagainst, and a fitting portion provided so as to be connected to the pivoting base portion so as to be fitted into the operating handle and clasp the supported part between the fitting portion and the abutment receiving portion, and the fitting portion has a pair of engagement projections projectingly provided thereon, the engagement projections each engaging with the respective support side walls in response to pivoting of the support member from the pre-assembly holding position to the assembly completion position.

Furthermore, according to a third aspect of the present invention, in addition to the second aspect, the support member has a pair of leg portions disposed inside the two support side walls so that base parts thereof are provided so as to be connected to the pivoting base portion while being capable of flexing so as to put extremity parts of the leg portions in proximity to each other, and engagement arm portions protruding outward from extremities of the two leg portions so as to engage with inner end parts of the two support side walls, which have been mounted on the vehicle door, when the support member is at the pre-assembly holding position and the assembly completion position.

Effects of the Invention

In accordance with the first aspect of the present invention, if in order to assemble the operating handle a pressing force accompanying the assembly operation acts from the operating handle on the support member at the pre-assembly holding position, since the support member pivots from the pre-assembly holding position to the assembly completion position to thus be engaged with and fixed to the base, and at the same time the supported part of the operating handle is pivotably clasped, when assembling the operating handle to the base, merely carrying out an operation of assembling the operating handle in a state in which the support member is assembled to the base and held at the pre-assembly holding position enables assembly of the operating handle to be completed, thereby enhancing the efficiency of the assembly operation.

Furthermore, in accordance with the second aspect of the present invention, since the support member integrally has the pivoting base portion pivotably supported on the pair of support side walls of the base, the abutment receiving portion provided so as to be connected to the pivoting base portion so as to make one end of the operating handle abut thereagainst, and the fitting portion provided so as to be connected to the pivoting base portion and clasp the supported part of the operating handle between itself and the abutment receiving portion, and the pair of engagement projections are projectingly provided on the fitting portion fitted into the operating handle, the pair of engagement projections engaging with the respective support side walls when the support member is at the assembly completion position, it is possible to reinforce the fitting portion while preventing the fitting portion from deforming due to a force acting from the operating handle in the direction in which the fitting portion of the support member drops when the operating handle is pivoted.

Moreover, in accordance with the third aspect of the present invention, since the pair of leg portions of the support member are disposed inside the two support side walls so as to be connected to the pivoting base portion while being capable of flexing so as to put the extremity parts thereof in proximity to each other, and the engagement arm portions protruding outward from the extremities of these leg portions can engage with the two support side walls when the support member is at the pre-assembly holding position and the assembly completion position, when the operating handle is removed from the base, gripping the two engagement arm portions and flexing the two leg portions so as to release the engagement with the support side walls enables the support member to pivot from the assembly completion position toward the pre-assembly holding position, and it is possible to easily remove the operating handle by disengaging the supported part of the operating handle from the support member. Moreover, the two engagement arm portions also engage with the two support walls when the support member is at the pre-assembly holding position, and it is unnecessary to provide a special holding structure on the base and the support member in order to hold the support member at the pre-assembly holding position, thereby avoiding any increase in molding cost.

EXPLANATION OF REFERENCE NUMERALS AND SYMBOLS

11 Vehicle door
13 Base
13*a* Support side wall
14 Operating handle
15 Support member
15*a* Pivoting base portion
15*c* Abutment receiving portion
15*d* Fitting portion
15*e* Leg portion
15*h* Engagement projections
15*f* Engagement arm portion
25 Supported part

MODES FOR CARRYING OUT THE INVENTION

A mode for carrying out the present invention is explained below by reference to the attached drawings.

Embodiment 1

Figure 1:
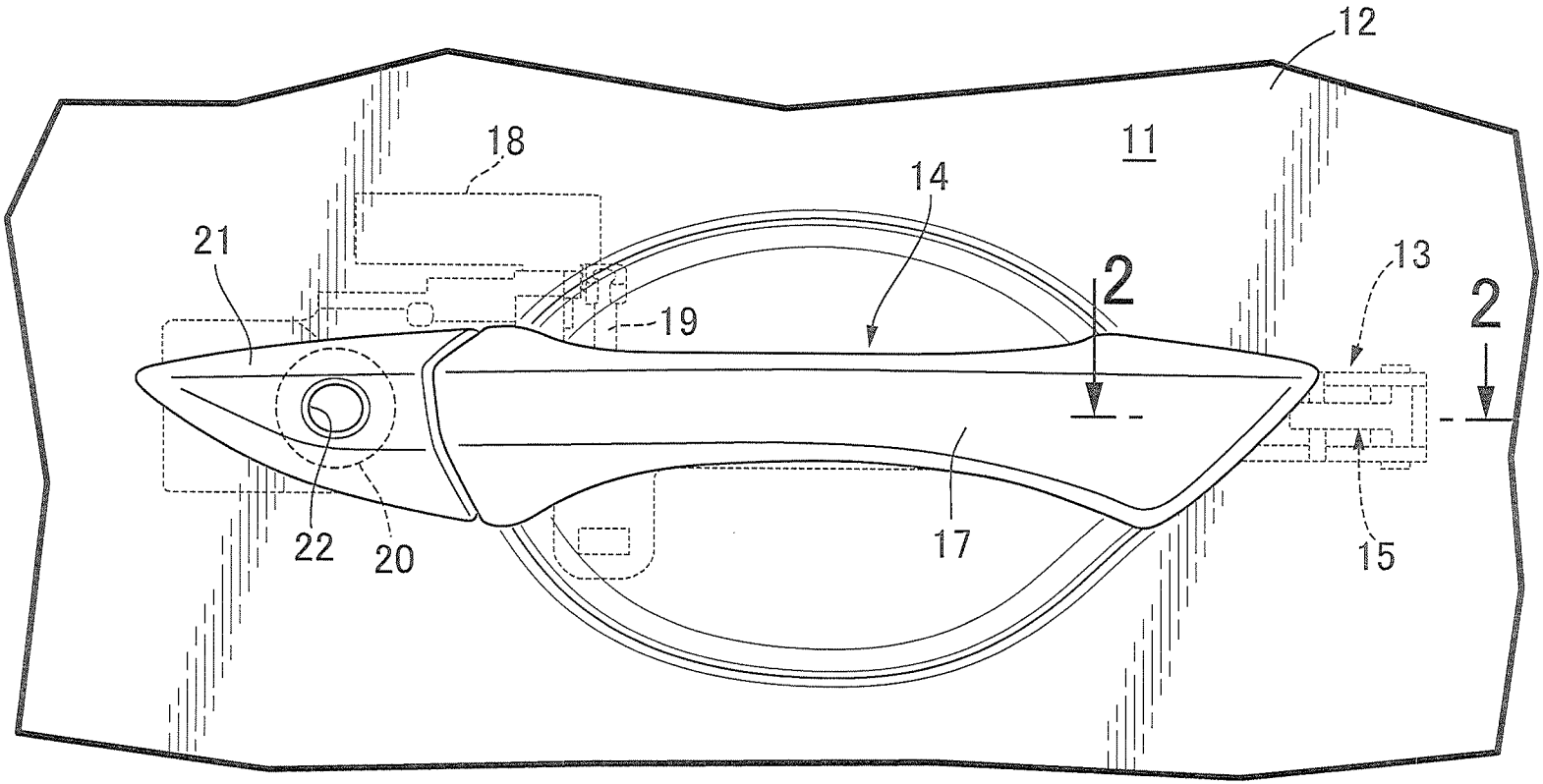
FIG. 1 is a partial side view of a vehicle door in a state in which an outside handle device is assembled thereto. (first embodiment)
Figure 2:
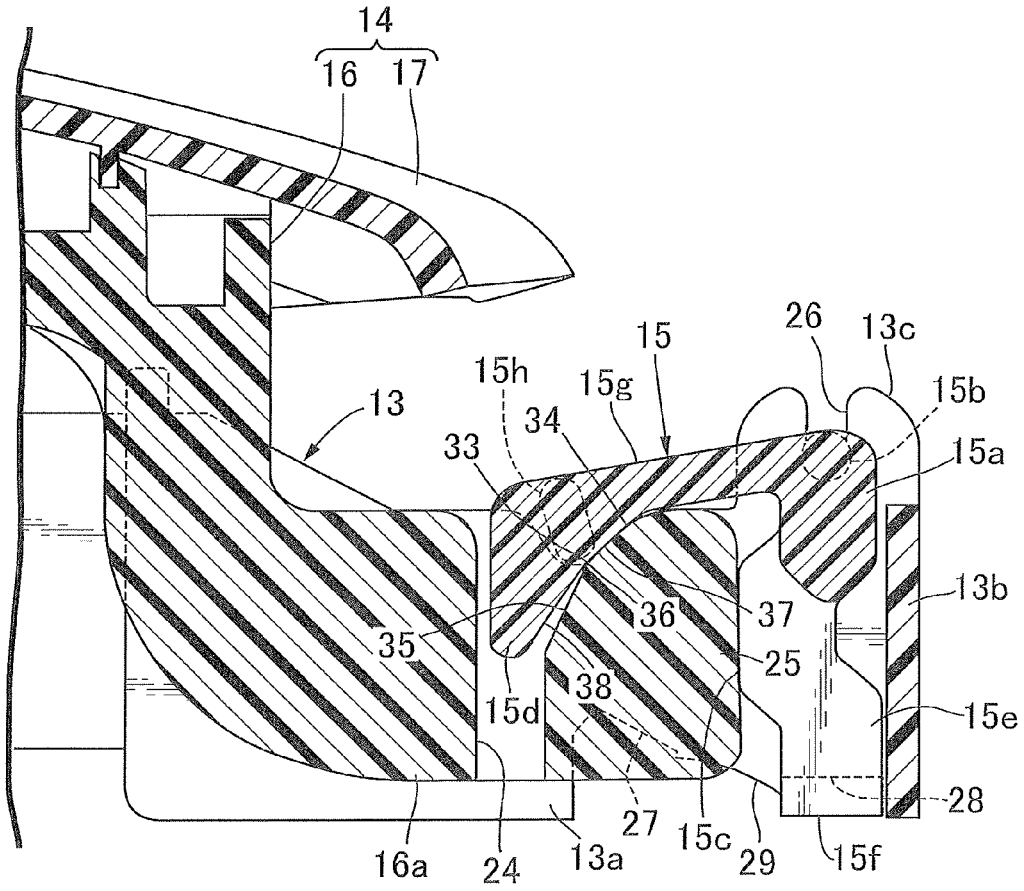
FIG. 2 is an enlarged sectional view along line 2-2 in FIG. 1. (first embodiment)

First in FIG. 1 and FIG. 2, an outside handle device is mounted on an outer panel 12 of a vehicle door 11, which is for example a side door of a passenger vehicle; the outside handle device includes a base 13 mounted on the outer panel 12, an operating handle 14 extending lengthwise in a fore-and-aft direction of a vehicle, and a support member 15 assembled to the base 13 while pivotably supporting one end part (right end part in FIG. 1) in a longitudinal direction of the operating handle 14, the operating handle 14 being formed by securing to each other a handle main body 16 formed from a hard synthetic resin so as to extend lengthwise in the fore-and-aft direction of the vehicle and a handle cover 17 formed from a synthetic resin so as to cover the handle main body 16.

The other end part (left end part in FIG. 1) in the longitudinal direction of the handle main body 16 of the operating handle 14 extends through the base 13 and projects inward of the outer panel 12, and a lever 18 linked to the other end part of the handle main body 16 so as to be operable in association therewith is pivotably supported on the base 13. A rod 19 linked to a door lock device, which is not illustrated, is linked to the lever 18, and a pulling force acts on the rod 19 in response to pivoting of the operating handle 14.

Furthermore, a cylinder lock 20 is mounted on the base 13 at a position spaced from the other end part in the longitudinal direction of the operating handle 14, and a lock cover 21 covering the cylinder lock 20 is formed into a shape that is smoothly connected to the handle cover 17 of the operating handle 14 in a non-operated state and mounted on the base 13, the lock cover 21 being provided with a key insertion hole 22 for allowing a mechanical key (not illustrated) to be inserted into the cylinder lock 20.

A substantially L-shaped support arm portion 16*a* is integrally formed with the handle main body 16 of the operating handle 14 on the one end side in the longitudinal direction, a fitting hole 24 is provided in an intermediate part of the support arm portion 16*a*, and the side of the support arm portion 16*a* further toward the extremity than the fitting hole 24, that is, the one end part of the handle main body 16, is formed as a supported part 25 pivotably supported by the support member 15. Furthermore, a pair of support side walls

13*a* and 13*a* are provided on the base 13, the pair of support side walls 13*a* and 13*a* extending along the longitudinal direction of the operating handle 14 while sandwiching the support arm portion 16*a*, including the supported part 25, from opposite sides, and the two support side walls 13*a* being linked to each other via a linking wall 13*b*.

Figure 3:
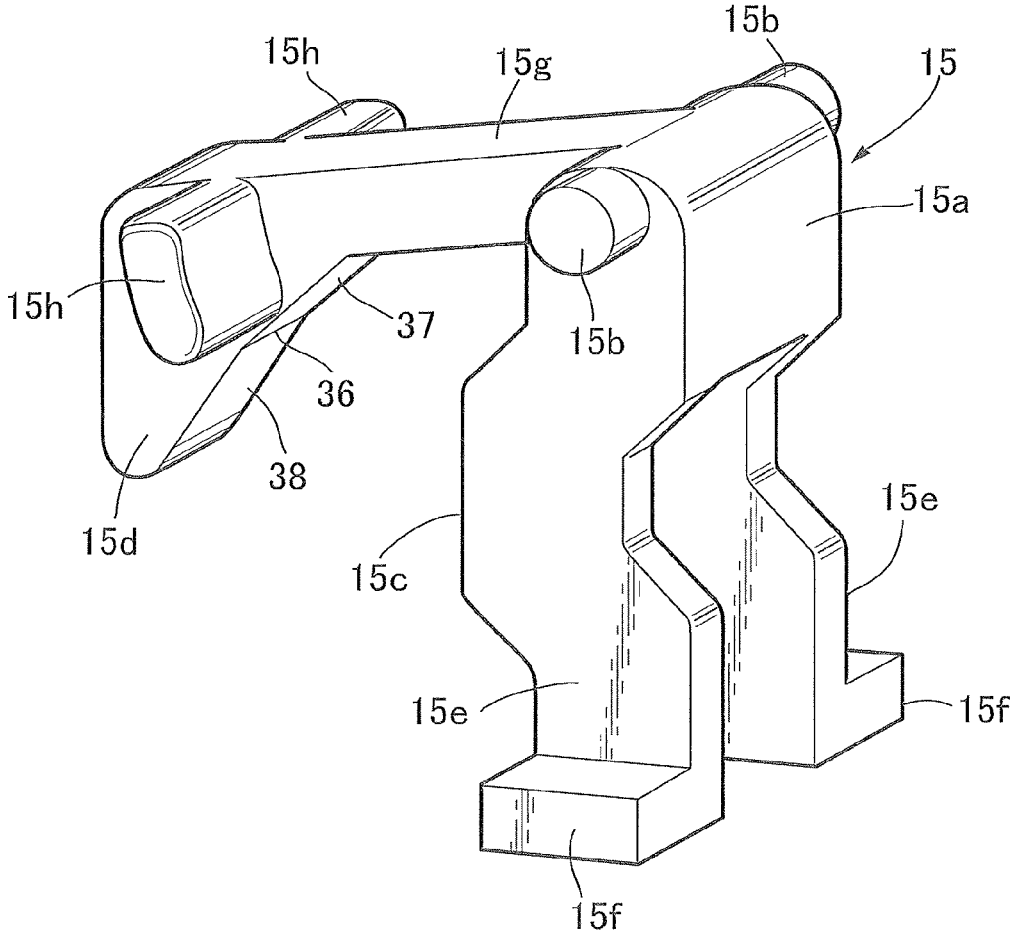
FIG. 3 is a perspective view of a support member. (first embodiment)

In FIG. 3, the support member 15 integrally has a pivoting base portion 15*a* provided with a pair of support shafts 15*b* and 15*b* projecting toward opposite sides thereof and pivotably supported by the two support side walls 13*a*, abutment receiving portions 15*c* provided so as to be connected to the pivoting base portion 15*a* while making one end of the support arm portion 16*a* of the operating handle 14, that is, the supported part 25, abut thereagainst, and a fitting portion 15*d* provided so as to be connected to the pivoting base portion 15*a* while being fitted into the fitting hole 24 of the support arm portion 16*a* of the operating handle 14 and clasping the supported part 25 between itself and the abutment receiving portions 15*c*.

Furthermore, the support member 15 integrally has a pair of leg portions 15*e* and 15*e* disposed inside the two support side walls 13*a* so that base parts thereof are provided so as to be connected to the pivoting base portion 15*a* while being capable of flexing so as to put extremity parts thereof in proximity to each other, and the abutment receiving portions 15*c* are each formed in intermediate parts of the two leg portions 15*e* so as to project toward the side that is distant from the linking wall 13*b* of the base 13. Moreover, the fitting portion 15*d* is provided so as to be connected to the pivoting base portion 15*a* in a central part between the two leg portions 15*e* via a linking arm portion 15*g* extending in a direction that is substantially perpendicular to the two leg portions 15*e*, and the two leg portions 15*e* having the abutment receiving portions 15*c* in the intermediate, the fitting portion 15*d*, and the linking arm portion 15*g* are disposed so as to form a substantially U-shape form when the support member 15 is viewed from a direction in which the two leg portions 15*e* are arranged so that they clasp the supported part 25 of the support arm portion 16*a* of the handle main body 16.

Figure 4:
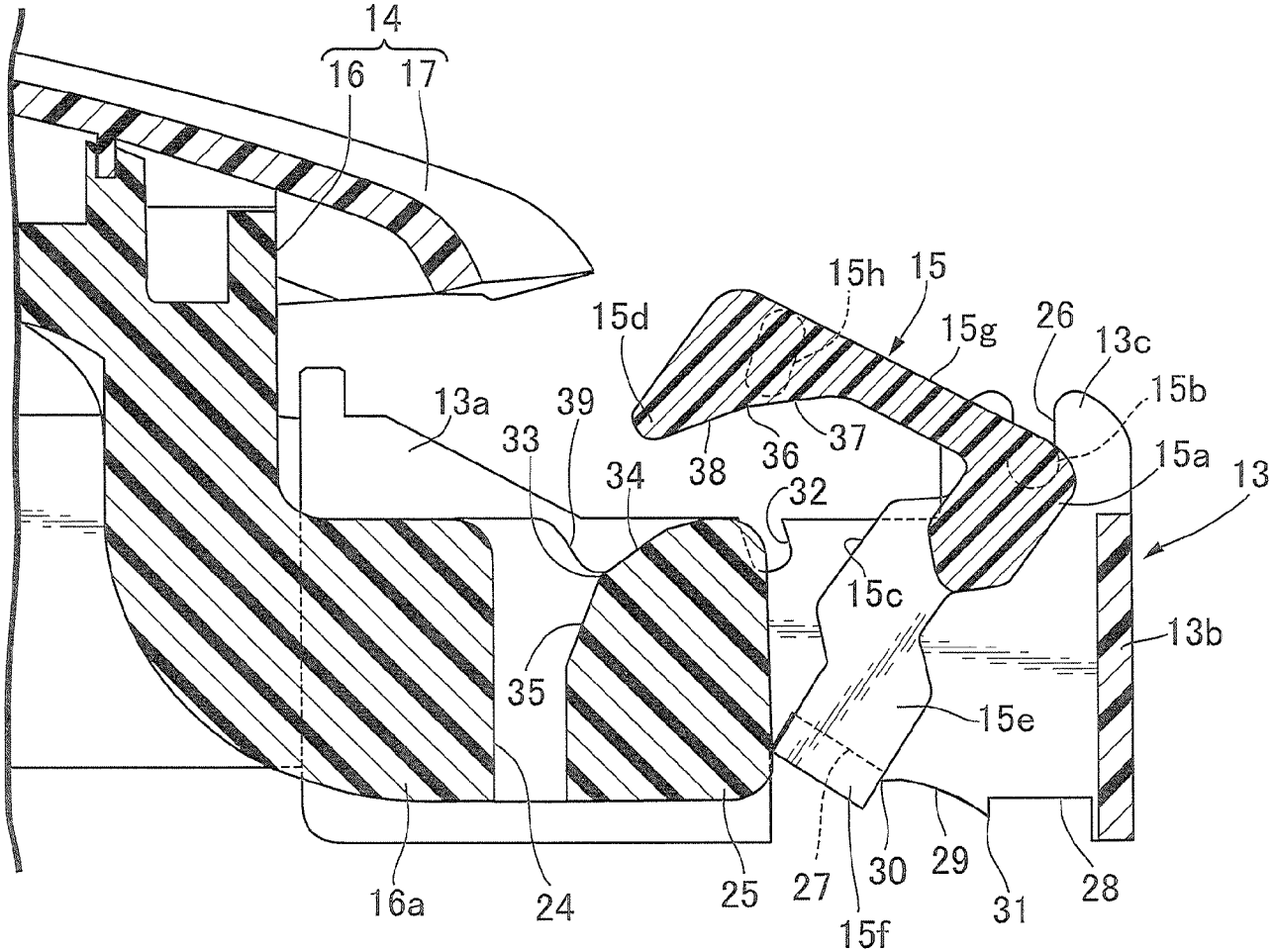
FIG. 4 is a sectional view, corresponding to FIG. 2, in a state in which the support member is at a pre-assembly holding position. (first embodiment)
Figure 5:
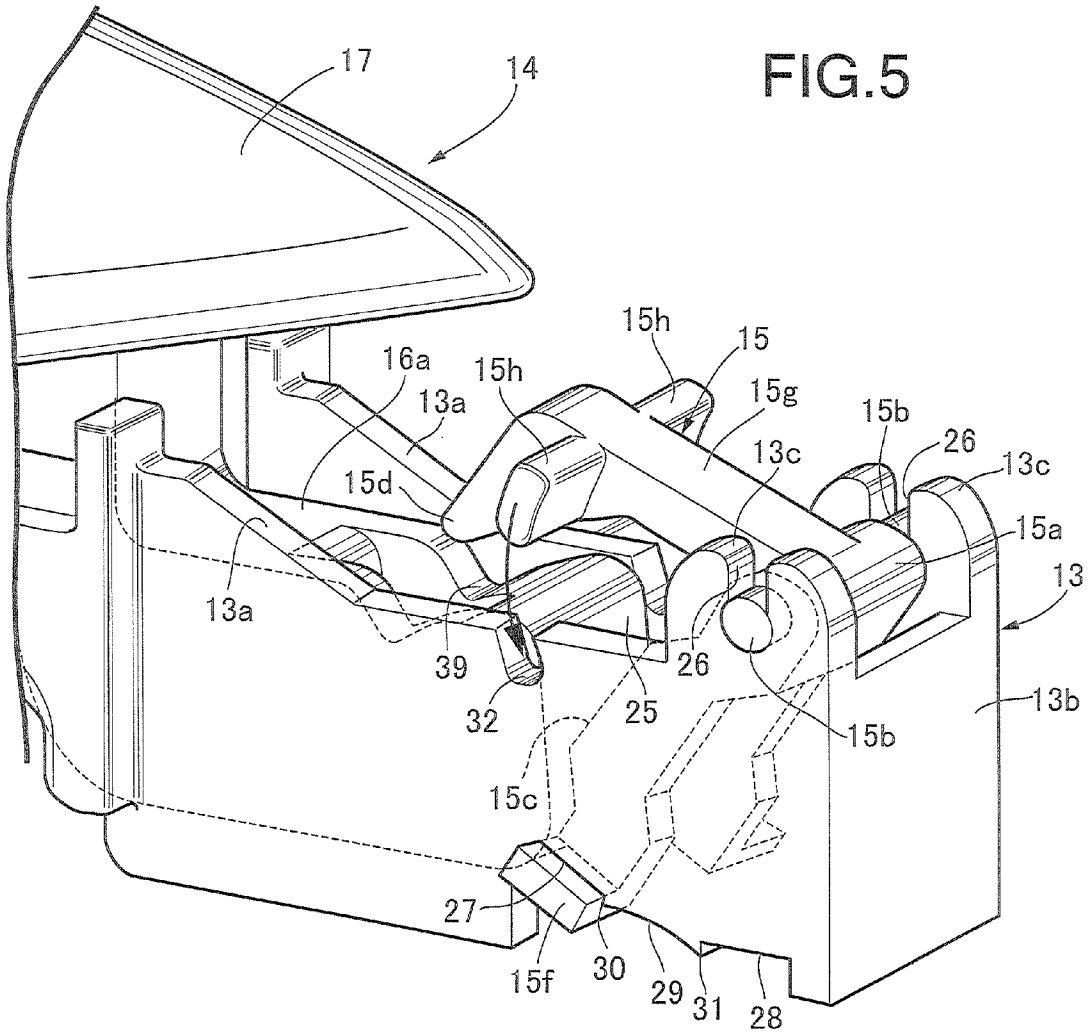
FIG. 5 is a perspective view of a base, an operating handle, and the support member when viewed from the outside in a state in which the support member is at the pre-assembly holding position. (first embodiment)
Figure 6:
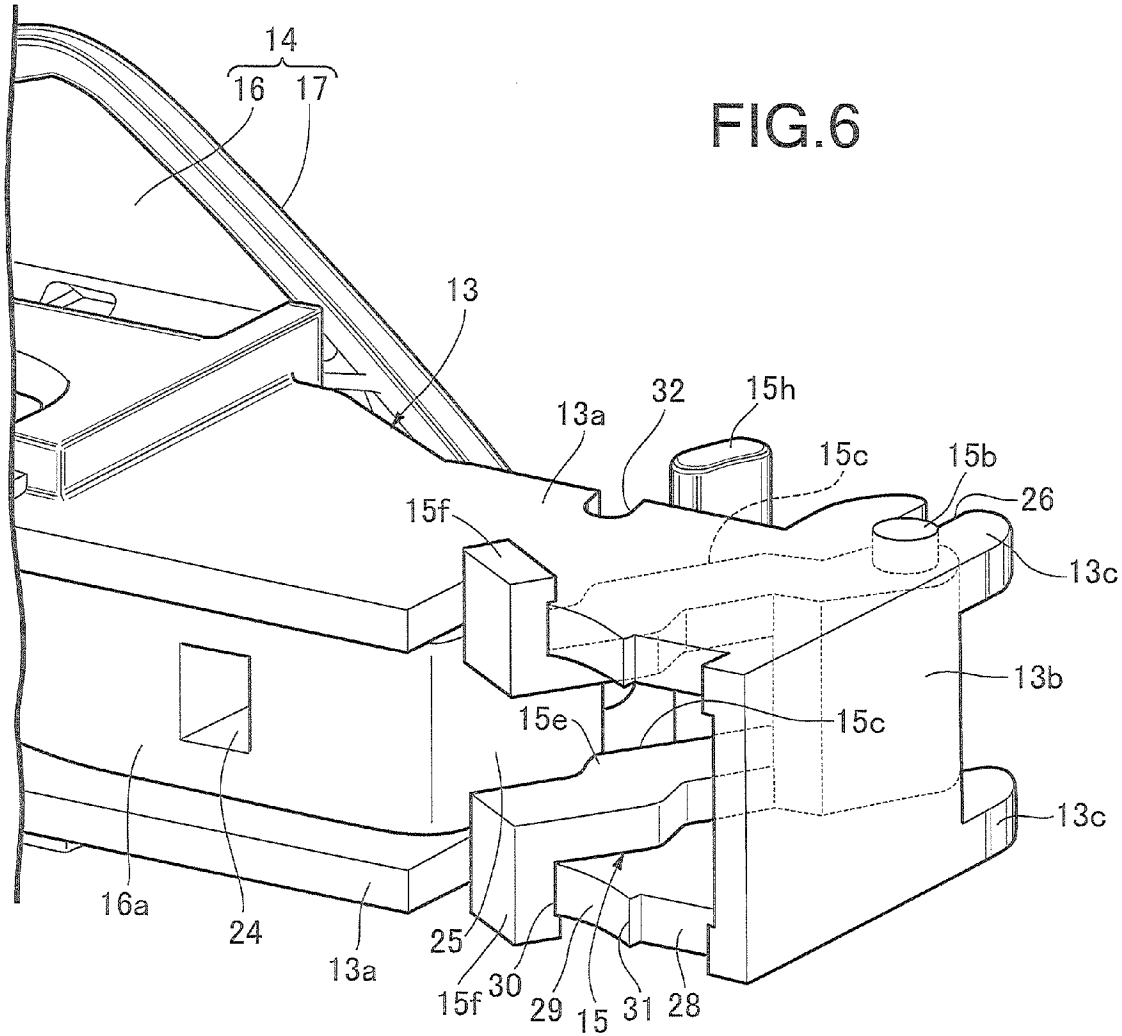
FIG. 6 is a perspective view of the base, the operating handle, and the support member when viewed from the inside in a state in which the support member is at the pre-assembly holding position. (first embodiment)
Figure 7:
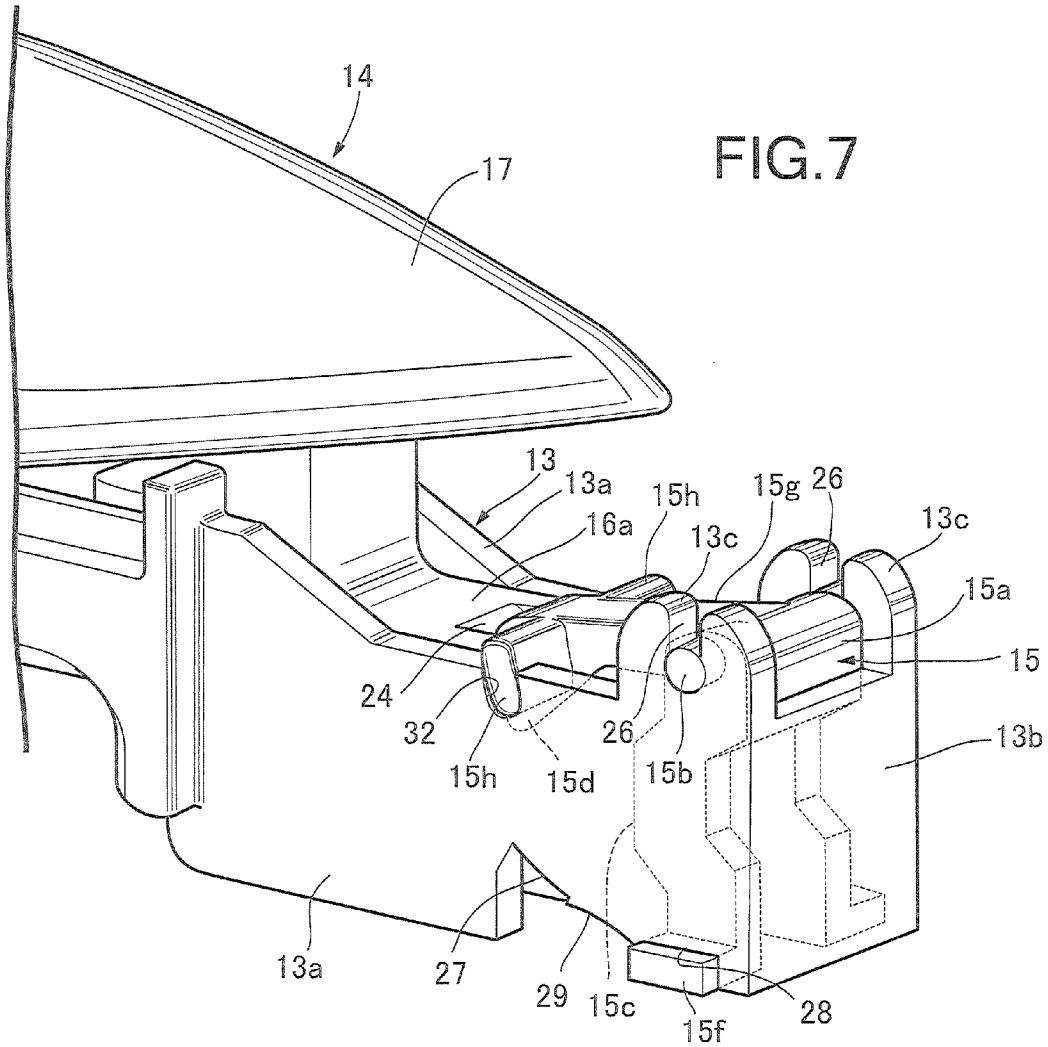
FIG. 7 is a perspective view of the base, the operating handle, and the support member when viewed from the outside in a state in which the support member is at an assembly completion position. (first embodiment)
Figure 8:
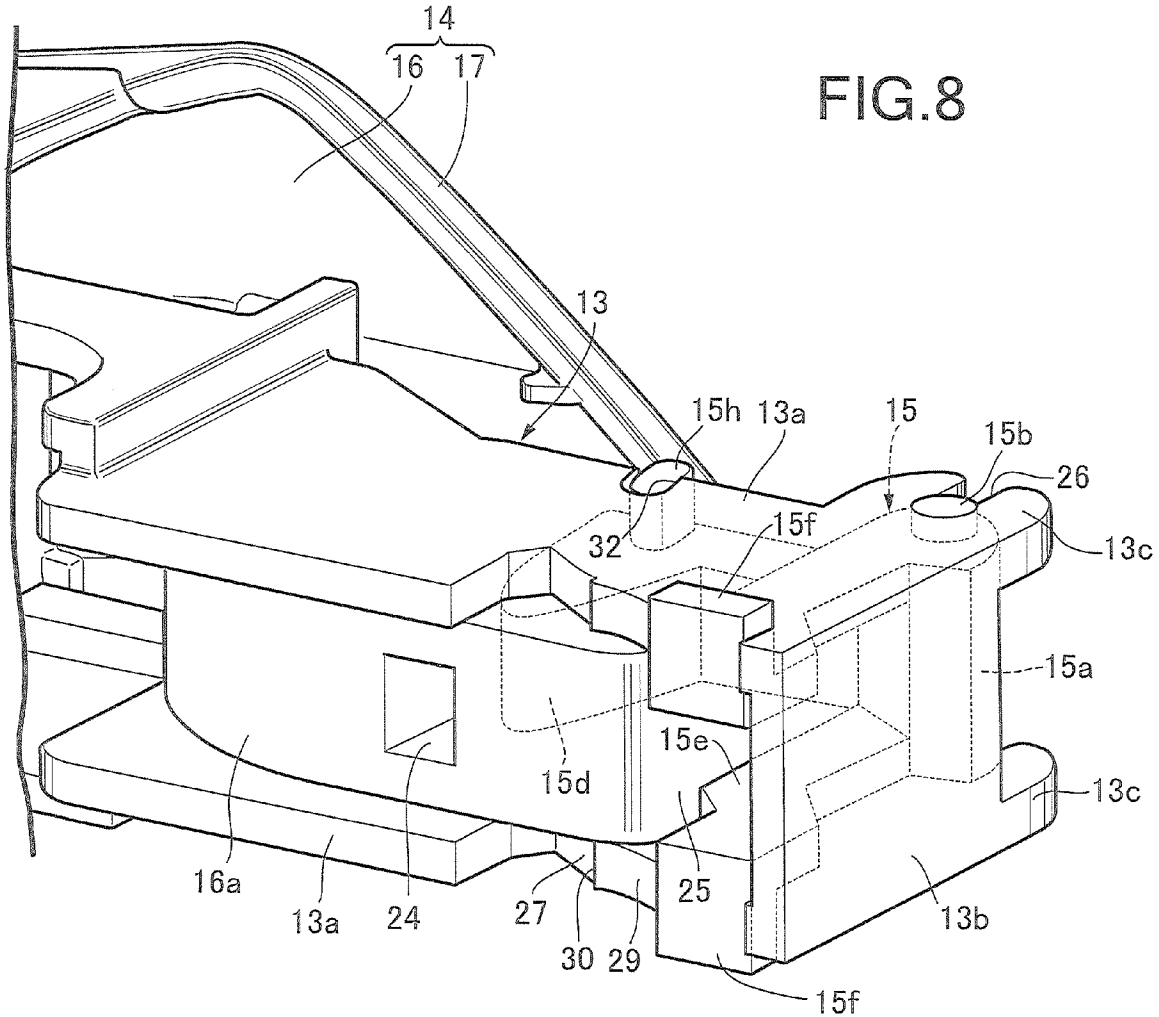
FIG. 8 is a perspective view of the base, the operating handle, and the support member when viewed from the inside in a state in which the support member is at the assembly completion position. (first embodiment)

The support member 15 is supported on the two support side walls 13*a* of the base 13 so as to be pivotable between a pre-assembly holding position shown in FIG. 4, FIG. 5, and FIG. 6 and an assembly completion position shown in FIG. 2, FIG. 7, and FIG. 8, brackets 13*c* and 13*c* are integrally provided with outer end parts of the two support side walls 13*a* in a state in which the base 13 is mounted on the vehicle door 11, and the support shafts 15*b* projecting toward opposite sides from the pivoting base portion 15*a* are each fitted into and supported by support recesses 26 and 26 provided in these brackets 13*c* and opening outward.

Engagement arm portions 15*f* and 15*f* protruding outward from extremities of the pair of leg portions 15*e* of the support member 15 are each provided so as to be connected integrally to the extremities of the leg portions 15*e*, and these engagement arm portions 15*f* can engage with inner end parts of the two support side walls 13*a*, which have been mounted on the vehicle door 11, when the support member 15 is at the pre-assembly holding position and at the assembly completion position, and are formed so as to make extremities project sideways from the two support side walls 13*a* in order to make it easy for an operator to grip them.

As shown in FIG. 4 and FIG. 5, the support member 15 at the pre-assembly holding position is in an attitude in which the two leg portions 15*e* are inclined so that one end of the support arm portion 16*a* of the handle main body 16 abuts against the extremities of the two leg portions 15*e*, first latching parts 27 with which the engagement arm portions 15*f* engage in this state being formed on inner end parts of the two support side walls 13*a*.

Furthermore, as shown in FIG. 2, FIG. 7, and FIG. 8, the support member 15 at the assembly completion position is in an attitude in which the two leg portions 15*e* are in proximity to and face the linking wall 13*b* of the base 13, second latching parts 28 with which the engagement arm portions 15*f* engage in this state being formed on inner end parts of the two support side walls 13*a*.

Moreover, intermediate linking parts 29 formed on inner end parts of the two support side walls 13*a* so as to provide a connection between the first and second latching parts 27, 28 are formed so as to be concave so that they do not interfere with pivoting of the engagement arm portions 15*f* when the support member 15 pivots between the pre-assembly holding position and the assembly completion position with the support shafts 15*b* as the center. Furthermore, first projections 30 are projectingly provided integrally with the two support side walls 13*a* between the first latching parts 27 and the intermediate linking parts 29, the linking engagement arm portion 15*f* being capable of riding over the first projections 30 as a result of a small force acting on the support member 15 at the pre-assembly holding position toward the assembly completion position, and second projections 31 are projectingly provided integrally with the two support side walls 13*a* between the second latching parts 28 and the intermediate linking parts 29 with an amount thereof projecting that is larger than that of the first projections 30, the second projections 31 preventing the engagement arm portion 15*f* from riding thereover even if a relatively large force acts on the support member 15 at the assembly completion position toward the pre-assembly holding position.

The support member 15 at the pre-assembly holding position is held by the base 13 so that it can pivot toward the assembly completion position in response to a pressing force acting from the support arm portion 16*a* of the handle main body 16 of the operating handle 14 accompanying an operation of assembling the operating handle 14, and accompanying the action of a pressing force from the operating handle 14 from the pre-assembly holding position to the assembly completion position the support member 15 pivotably clasps the supported part 25 of the support arm portion 16*a* of the handle main body 16 and is engaged with the base 13 at the assembly completion position.

Moreover, a pair of engagement projections 15*h* and 15*h* are projectingly provided on opposite side faces of the fitting portion 15*d* of the support member 15, the pair of engagement projections 15*h* and 15*h* each engaging with latching recesses 32 and 32 provided in outer end parts of the two support side walls 13*a* in response to pivoting of the support member 15 from the pre-assembly holding position to the assembly completion position, and with regard to the support member 15 at the assembly completion position, the engagement arm portions 15*f* engage with the second latching parts 28 formed on the inner end parts of the two support side walls 13*a*, and the engagement projections 15*h* engage with the latching recesses 32 provided in the outer end parts of the two support side walls 13*a*, thereby making the support member 15 engage with and be fixed to the base 13.

Figure 9:
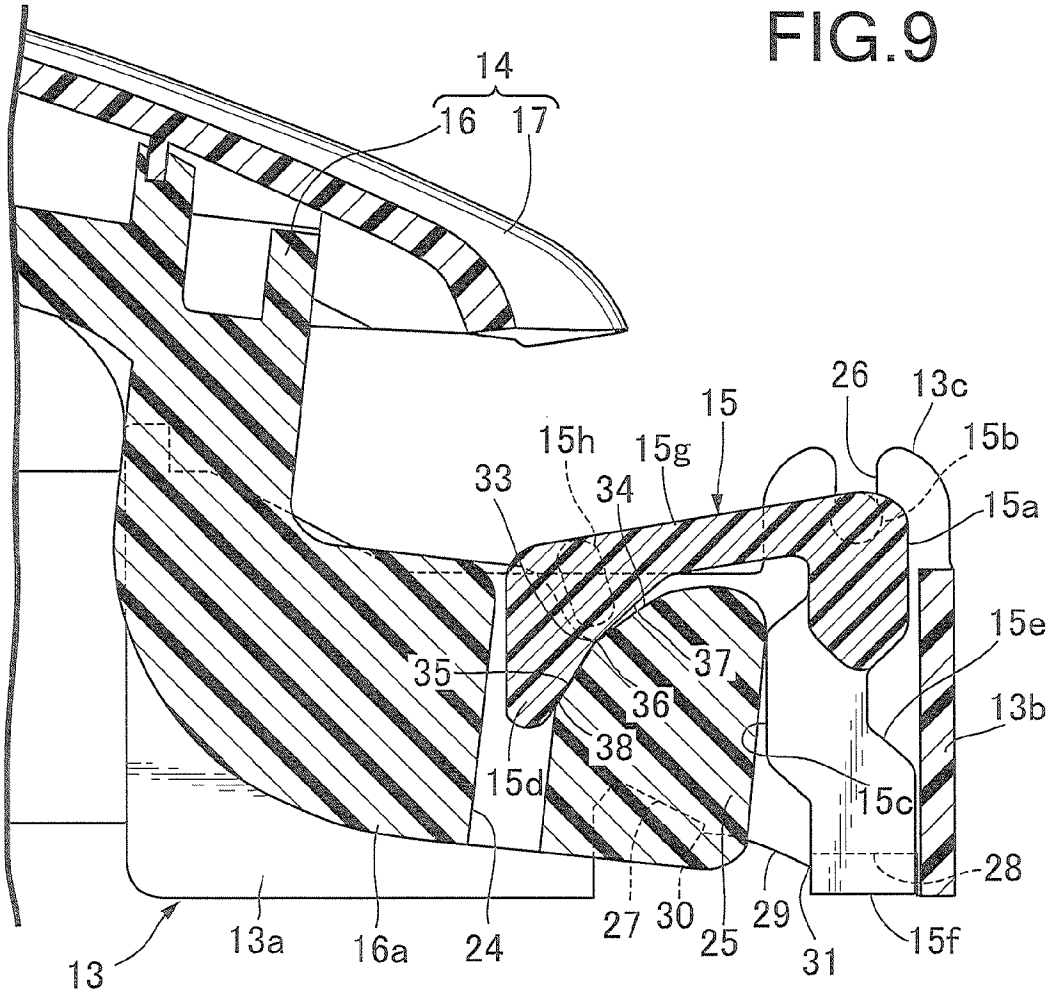
FIG. 9 is a sectional view, corresponding to FIG. 2, in a state in which the operating handle has been pivoted. (first embodiment)

Faces of the supported part 25 of the operating handle 14 that are opposite the fitting portion 15*d* of the support member 15 at the assembly completion position while clasping the supported part 25 are formed as first and second abutment faces 34 and 35 that are inclined so as to form an angle therebetween with a bent projection 33 projecting toward the fitting portion 15*d* sandwiched therebetween, portions, opposite the first and second abutment faces 34 and 35, of the fitting portion 15*d* are formed as first and second restricting faces 37 and 38 that are inclined so as to form an angle therebetween with a bent recess 36 recessed so as to abut against the bent projection 33 sandwiched therebetween, and the supported part 25 pivots with the point of the bent projection 33 abutting against the bent recess 36 as a fulcrum. When the operating handle 14 is not operated, as shown in FIG. 2, the first abutment face 34 abuts against the first restricting face 37, but when the operating handle 14 is pivoted, as shown in FIG. 9, the supported part 25 of the operating handle 14 pivots until the second abutment face 35 abuts against the second restricting face 38.

Furthermore, when the supported part 25 is pivoted by operation of the operating handle 14, the supported part 25 abuts against the fitting portion 15*d* and the abutment receiving portions 15*c* of the support member 15, and rattling of the operating handle 14 in the fore-and-aft direction of the vehicle does not occur.

Furthermore, recesses 39 for disposing the engagement projections 15*h* on opposite sides of the fitting portion 15*d* are provided, so as to be connected to the fitting hole 24, in the support arm portion 16*a* on opposite sides of the fitting hole 24 provided in the support arm portion 16*a* of the handle main body 16, and these recesses 39 are formed so that the supported part 25 does not come into contact with the engagement projections 15*h* when the supported part 25 is pivoted by pivoting of the operating handle 14.

The operation of this embodiment is now explained; since the support member 15 pivotably supporting the supported part 25 formed in the one end part, in the longitudinal direction, of the operating handle 14 extending lengthwise in the fore-and-aft direction of the vehicle is pivotably supported on the base 13 mounted on the vehicle door 11 so that the support member 15 can pivot between the pre-assembly holding position and the assembly completion position, this support member 15 is formed so that at the pre-assembly holding position it is held by the base 13 so as to pivot toward the assembly completion position in response to a pressing force acting from the operating handle 14 accompanying an assembly operation of the operating handle 14, and when pivoting from the pre-assembly holding position to the assembly completion position accompanying the pressing force acting from the operating handle 14 it pivotably clasps the supported part 25 and is engaged with and fixed to the base 13 at the assembly completion position, when a pressing force from the operating handle 14 accompanying an assembly operation in order to assemble the operating handle 14 acts on the support member 15 at the pre-assembly holding position, the support member 15 pivots from the pre-assembly holding position to the assembly completion position and is engaged with and fixed to the base 13, and at the same time it pivotably clasps the supported part 25 of the operating handle 14. When assembling the operating handle 14 to the base 13, it is therefore possible to complete assembly of the operating handle 14 merely by assembling the operating handle 14 in a state in which the support member 15 is assembled to the base 13 and held at the pre-assembly holding position, thereby enhancing the efficiency of the assembly operation.

Furthermore, since the base 13 has the pair of support side walls 13*a* extending along the longitudinal direction of the operating handle 14 while sandwiching the supported part 25 of the operating handle 14 from opposite sides, the support member 15 integrally has the pivoting base portion 15*a* pivotably supported on the outer end parts of the two support side walls 13*a*, which have been mounted on the vehicle door 11, the abutment receiving portions 15*c* provided so as to be connected to the pivoting base portion 15*a* while making the one end of the operating handle 14 abut thereagainst, and the fitting portion 15*d* provided so as to be connected to the pivoting base portion 15*a* while being fitted into the operating handle 14 and clasping the supported part 25 between itself and the abutment receiving portions 15*c*, and the pair of engagement projections 15*h* each engaging with the two support side walls 13*a* when the support member 15 is at the assembly completion position are projectingly provided on the fitting portion 15*d*, it is possible to reinforce the fitting portion 15*d* while preventing the fitting portion 15*d* from deforming due to a force from the operating handle 14 in the direction in which the fitting portion 15*d* of the support member 15 drops when the operating handle 14 is pivoted.

Moreover, since the support member 15 has the pair of leg portions 15*e* disposed inside the two support side walls 13*a* so that the base parts thereof are provided so as to be connected to the pivoting base portion 15*a* while being capable of flexing so as to put extremity parts thereof in proximity to each other, and the engagement arm portions 15*f* protruding outward from the extremities of the two leg portions 15*e* so as to engage with inner end parts of the two support side walls 13*a*, which have been mounted on the vehicle door 11, when the support member 15 is at the pre-assembly holding position and the assembly completion position, when the operating handle 14 is removed from the base 13, gripping the two engagement arm portions 15*f* and flexing the two leg portions 15*e* so as to release the engagement with the support side walls 13*a* enables the support member 15 to pivot from the assembly completion position toward the pre-assembly holding position, and it is possible to easily remove the operating handle 14 by disengaging the supported part 25 of the operating handle 14 from the support member 15. Moreover, the two engagement arm portions 15*f* also engage with the two support walls 13*a* when the support member 15 is at the pre-assembly holding position, and it is unnecessary to provide a special holding structure on the base 13 and the support member 15 in order to hold the support member 15 at the pre-assembly holding position, thereby avoiding any increase in molding cost.

An embodiment of the present invention is explained above, but the present invention is not limited to the above-mentioned embodiment and may be modified in a variety of ways as long as the modifications do not depart from the spirit and scope thereof.

The invention claimed is:

1. An outside handle device for a vehicle door, comprising a base (13) mounted on a vehicle door (11), an operating handle (14) extending lengthwise in a fore-and-aft direction of a vehicle, and a support member (15) assembled to the base (13) while pivotably supporting a supported part (25) formed in one end part, in a longitudinal direction, of the operating handle (14), characterized in that the support member (15) pivotably supported on the base (13) so as to be pivotable between a pre-assembly holding position and an assembly completion position is formed so as to be held by the base (13) so that at the pre-assembly holding position the support member (15) can pivot toward the assembly completion position in response to a pressing force acting from the operating handle (14) accompanying an operation of assembling the operating handle (14), and so as to pivotably clasp the supported part (25) and be engaged with and fixed to the base (13) at the assembly completion position when pivoting accompanying a pressing force acting from the operating handle (14) from the pre-assembly holding position to the assembly completion position.

2. The outside handle device for a vehicle door according to claim 1, wherein the base (13) has a pair of support side walls (13*a*) extending along the longitudinal direction of the operating handle (14) while sandwiching the supported part (25) of the operating handle (14) from opposite sides, the support member (15) integrally has a pivoting base portion (15*a*) pivotably supported on an outer end part of the two support side walls (13*a*), which have been mounted on the vehicle door (11), an abutment receiving portion (15*c*) provided so as to be connected to the pivoting base portion (15*a*) so as to make one end of the operating handle (14) abut thereagainst, and a fitting portion (15*d*) provided so as to be connected to the pivoting base portion (15*a*) so as to be fitted into the operating handle (14) and clasp the supported part (25) between the fitting portion (15*d*) and the abutment receiving portion (15*c*), and the fitting portion (15*d*) has a pair of engagement projections (15*h*) projectingly provided thereon, the engagement projections (15*h*) each engaging with the respective support side walls (13*a*) in response to pivoting of the support member (15) from the pre-assembly holding position to the assembly completion position.

3. The outside handle device for a vehicle door according to claim 2, wherein the support member (15) has a pair of leg portions (15*e*) disposed inside the two support side walls (13*a*) so that base parts thereof are provided so as to be connected to the pivoting base portion (15*a*) while being capable of flexing so as to put extremity parts of the leg portions (15*e*) in proximity to each other, and engagement arm portions (15*f*) protruding outward from extremities of the two leg portions (15*e*) so as to engage with inner end parts of the two support side walls (13*a*), which have been mounted on the vehicle door (11), when the support member (15) is at the pre-assembly holding position and the assembly completion position.

* * * * *